US007552813B2

(12) United States Patent
González Alemany et al.

(10) Patent No.: US 7,552,813 B2
(45) Date of Patent: Jun. 30, 2009

(54) SAFETY DEVICE FOR MOVING HANDRAILS

(75) Inventors: Miguel Angel González Alemany, Oviedo (ES); Juan Domingo Gonzalez Pantiga, Gijón (ES); Manuel Alonso Cuello, Gijón (ES); José Mendiolagoitia Juliana, Gijón (ES); Francisco Palomero Cocho, Gijon (ES)

(73) Assignees: Thyssenkrupp Norte S.A., Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 41 days.

(21) Appl. No.: 11/966,528

(22) Filed: Dec. 28, 2007

(65) Prior Publication Data

US 2008/0185265 A1 Aug. 7, 2008

(30) Foreign Application Priority Data

Dec. 29, 2006 (ES) ..... 200603325
Aug. 8, 2007 (ES) ..... 200702239

(51) Int. Cl.
*B66B 23/22* (2006.01)

(52) U.S. Cl. ..... 198/338; 198/323

(58) Field of Classification Search ..... 198/323, 198/338

See application file for complete search history.

(56) References Cited

U.S. PATENT DOCUMENTS 3,809,206 A * 5/1974 Bredehorn et al. ..... 198/323
3,835,977 A 9/1974 Hewitt et al.
3,934,699 A * 1/1976 Saito et al. ..... 198/323
4,619,355 A * 10/1986 Adrian et al. ..... 198/323
4,924,995 A * 5/1990 Adrian et al. ..... 198/323
5,366,060 A * 11/1994 Johnson et al. ..... 198/338
5,443,145 A * 8/1995 Schoeneweiss ..... 198/338
5,465,823 A * 11/1995 Schoeneweiss ..... 198/338
6,752,255 B2 6/2004 Lefeuvre
2008/0185264 A1 8/2008 Gonzalez Alemany et al.

FOREIGN PATENT DOCUMENTS

ES 2 285 949 11/2007
FR 2 830 526 4/2003
JP 2004/224553 8/2004

* cited by examiner

*Primary Examiner*—James R Bidwell
(74) *Attorney, Agent, or Firm*—Merchant & Gould P.C.

(57) ABSTRACT

The invention relates to improvements introduced in invention patent number 200602335 relating to a safety system for moving handrails comprising a plurality of moving handgrips (1), the system having a retractable stop (5) inside the railing (3), a support structure (7), joined to the railing (3), having a guide (9), a lowerable body (11) with respect to the structure (7) and having a guiding rod (12) with a runner (13) and a roller (14) moving parallel to the handgrips (1) and a driving element (15) of the body (11), one of the ends (15*b*) of which is rotatably connected to the support structure (7) and the other end (15*a*) is rotatably connected to the lowerable body (11), such that when the retractable stop (5) is pushed by the hand of the user, the rod (12) is moved and the runner (13) is released from the guide (9), the lowerable body (11) being lowered due to the effect of the driving element (15).

4 Claims, 5 Drawing Sheets

SAFETY DEVICE FOR MOVING HANDRAILS

FIELD OF THE INVENTION

The present invention relates to a safety device for moving handrails, especially designed for its use in handrails used in mechanical stairs or walkways and moving simultaneously with the latter.

The object of the invention is to provide said handrails with a safety device preventing the hands of the users from being trapped in the place where the actual handrail is concealed, at the exit of the walkway of stairs, to return in an also concealed manner to the start of the mechanical stairs or walkway.

The invention is thus comprised in the scope of mechanical stairs or walkways, such as those used in airports, department stores, etc.

BACKGROUND OF THE INVENTION

Both in the case of walkways and mechanical stairs, either the moving platform for transporting persons or objects or the steps, move accompanied in a synchronized manner by a handrail aiding in the corporal stability of the user when it is driven by the moving surface on which it rests.

There are different structural solutions for the actual handrail, one of such solutions consisting of an alignment of handgrip-carriages, which at the end of the walkway or of the mechanical stairs are concealed under a fixed structure or railing, where said handgrip-carriages undergo a 180° C. inflexion in their path, to again return to the start of the walkway or stairs, carrying out this return path in a concealed condition, to access the work line through another railing similar to the exit railing.

The mentioned exit railing is usually provided, in correspondence with the entrance opening for the moving handrail, with an inclined plane or ramp tending to separate the hand of the user from the handgrip-carriage which he or she is holding at the critical time in which the handrail penetrates the railing, in order to prevent accidents due to the "pinching" of the hand between the mentioned fixed and moving elements from occurring.

However, said inclined plane is not enough to provide the handrail with the sufficient safety, and practice shows that these types of accidents can occur.

In addition, the solution set forth by patent number 200603325 consists of arranging a stop in correspondence with the opening for accessing the inside of the railing, said stop being retractable and a longitudinal rod being joined thereto. An outer lid assembled on the fixed part of the railing which is laterally lowerable with respect to the latter between an open position and a closed position and an inner lid assembled on the fixed part of the railing which is also laterally lowerable with respect to the latter between an open position and a closed position are further arranged, said inner lid being connected to the outer lid so that the inner lid and the outer lid are opened together. The longitudinal rod and the stop are associated, with the possibility of longitudinal movement, to the outer lid, said longitudinal rod comprising locking means for the mentioned lid in a closed position.

In said solution, the mentioned lids are opened due to the movement of the stop driving the rod having a runner with wheels moving a housing made in the fixed base of the railing, said housings having an exit allowing, when the mentioned wheels move, the release of the outer lid which is automatically lowered due to the action of a hinge with a spring in its lowering shaft, the outer lid having at its upper part a pawl releasing the inner lid at the same time, which lid swings due to the effect of gravity.

Since two lids are needed, the mentioned solutions can have problems in the joint lowering of such lids, one of the lids occasionally being open and not achieving the initially desired effect (the complete opening of both lids at the same time so that there is no risk for the hand of the user of the walkway or mechanical stairs). In addition, the resetting of the system makes it necessary to close both lids in a special manner so that both of them are engaged by means of the mentioned pawl, their synchronization not being completely automated in the closing.

In addition, the mentioned solution had drawbacks inherent to its design since it was formed by two independent parts. With this system there is a risk of an incorrect operation due to interferences between the inner lid and the outer lid. The manufacture, assembly, adjustment and maintenance are difficult due to the high dimensional accuracy required in a device with these features. Likewise, the resetting of the system is complex as a result of the poor accessibility of the inner lid once it is actuated and due to the need of closing the two lids at the same time, the intervention of two operators being necessary to carry it out. It must also be added that it is necessary to open the outer lid so that the micro responsible for cutting off the power supply to the actuation of the walkway or stairs is activated.

SUMMARY OF THE INVENTION

The present invention relates to a safety device for moving handrails such as those used in transport systems comprising walkways and mechanical stairs, wherein said handrail, at an exit end of the handrail, comprises a plurality of moving handgrips which can move on a modular guide covered by them, said moving handgrips penetrating, at their exit end, inside a fixed and hollow railing having an opening.

The device comprises a stop, located in correspondence with the opening, which is retractable against the tension of at least one spring.

The device is characterized by comprising a lower support structure forming part of the railing itself, said structure comprising a front plate at the upper front end of which there is arranged at least one retaining guide and a rear plate, said plates being connected by a plurality of bars perpendicular thereto. The device further comprises a body which is lowerable with respect to said support structure according to a rotating shaft perpendicular to the forward direction of the moving handgrips, said rotating shaft being located in the rear plate of the support structure and the lowerable body of which in turn comprises a guiding rod integral with the stop to which a runner is joined in an integral manner, which runner has a roller which can move in a direction parallel to the forward direction of the moving handgrips on the guide when the stop is acted upon.

The device finally comprises a driving element of the lowerable body, one of the ends of which is connected with the possibility of rotation to the support structure and the other end of which is connected with the possibility of rotation to the lowerable body.

Thus, when the retractable stop is pushed by the hand of the user, the movement is transmitted by the guiding rod moving the runner, which is releases from the guide, the lowerable body being lowered due to the effect of the driving element.

Due to the configuration of the safety system for moving handrails defined by the present invention, the new design is more compact and lightweight, in a single part, which allows a much simpler adjustment during the assembly, provided with more adjustment possibilities to thus achieve an optimal positioning. With the new configuration of the system, a single person can carry out the resetting in a simple and intuitive manner.

The smoothness and the opening of the system have been optimized with the new design, while at the same time the microswitch before the assembly is started to be opened, minimizing the activation time of the safety. The greatest advantage of this development has been the use of inner elements provided with less aggressive geometries for the user, avoiding sharp edges which can harm the user in a hypothetical contact with them, in addition to the use of plastic material, which contributes to achieving this objective. A safety device for the entrance of handrails has therefore been obtained which is simpler and more effective than the original proposal.

Another aspect of the invention contemplates the possibility that the driving element consists of a gas cylinder which is compressed in the rest position of the device. Thus, when the runner of the lowerable element is released, the compressed force in the cylinder enables the rotation or lowering of said element with respect to the support structure.

An electronic microswitch can be arranged on the retaining guide of the support structure, which microswitch, in the folded position of the lowerable body, will keep the power circuit of the mechanical walkway associated to the handrail on, the movement thereof occurring, and, in the lowered position of said lowerable body will be actuated by the roller of the runner associated to the lowerable body, interrupting the power circuit of the walkway and stopping it. In this way, once it has been activated, the safety device, at the same time as the lowerable body, rises and prevents the hand from being trapped by it when the walkway stops completely and therefore the handrail moves in a synchronized manner with said walkway.

A final aspect of the invention contemplates the possibility of having a pair of sensors located in front of a moving stop, emerging substantially from the railing in the area for accessing such railing, by the actual handrail. The function of said sensors is to detect the presence of a hand of a user located close to the entrance of the handrail. In the event of a positive detection, the user would be warned that he or she is approaching the entrance of the handrail by means of acoustical signal.

BRIEF DESCRIPTION OF THE DRAWINGS

The constitution, way of assembling and advantages of the safety device for moving handrails are described below with more detail in the attached drawings, which aid in better understanding the invention and are expressly related with embodiments of said invention which are set forth as illustrative and non-limiting examples thereof.

DETAILED DESCRIPTION OF THE PREFERRED EMBODIMENT(S)

As can be seen in the different figures provided together with the present description, the device object of the present invention will be integrated in a moving walkway (not shown) and more specifically in the railing arranged at the end of the run of said walkway.

Said walkway has a handrail which can also move linearly in a direction parallel to the direction of movement of the walkway. Said handrail is formed by a plurality of moving handgrips (1) by way of handgrip-carriages which can move on a modular guide (2), moving handgrips penetrating a fixed railing (3) forming part of the structure of the moving walkway. The return of said moving handgrips (1) occurs inside the railing (3) to reach, in a manner concealed by the railing itself, the entrance of the walkway or stairs, and thus restart the operating cycle of the mentioned handrail.

Figure 3A:
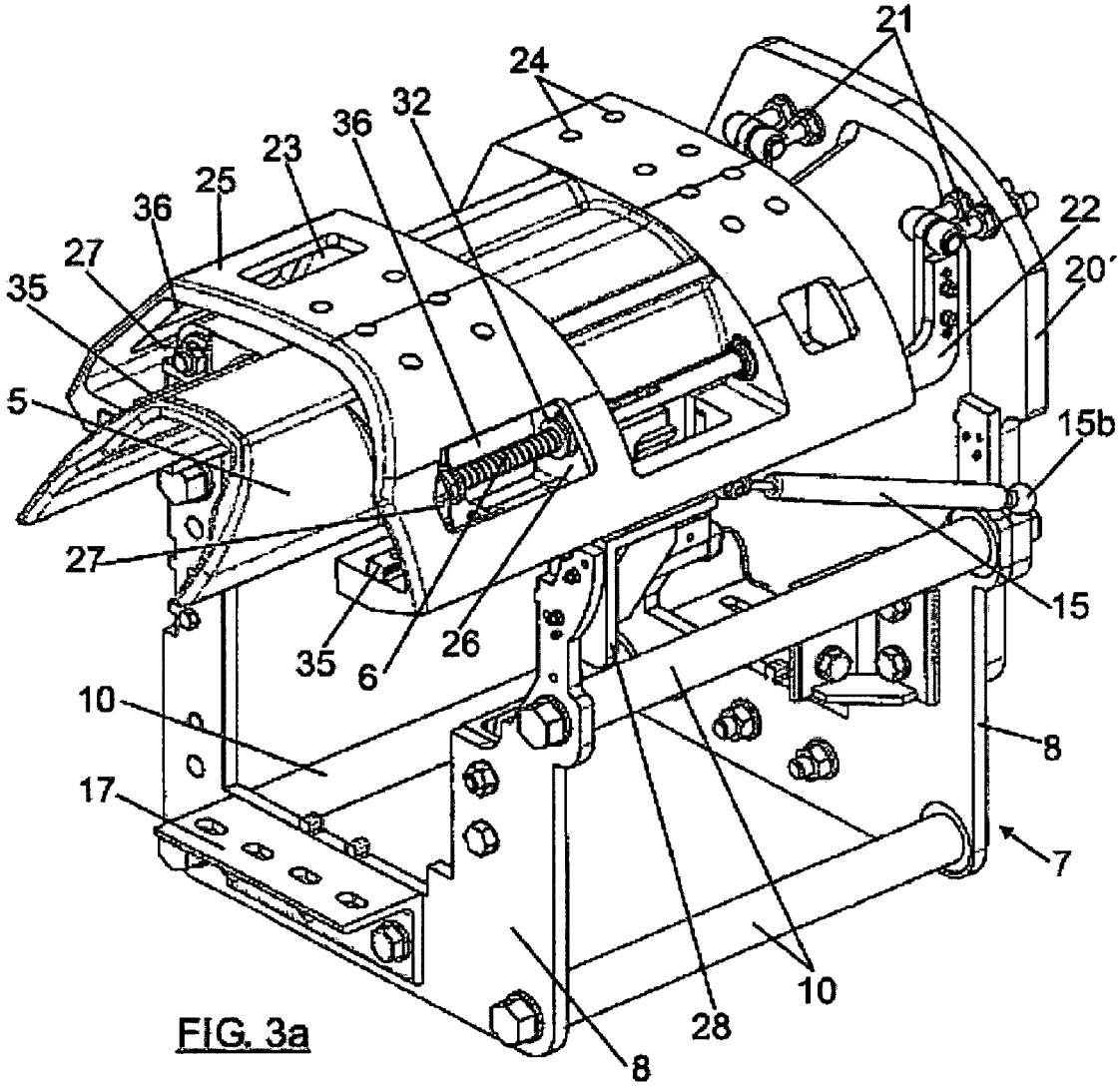
FIG. 3*a* shows a perspective view of the isolated safety device (without showing the rest of the structure of the handrail), the device being in a rest position when the upper part has still not been unfolded.
Figure 3B:
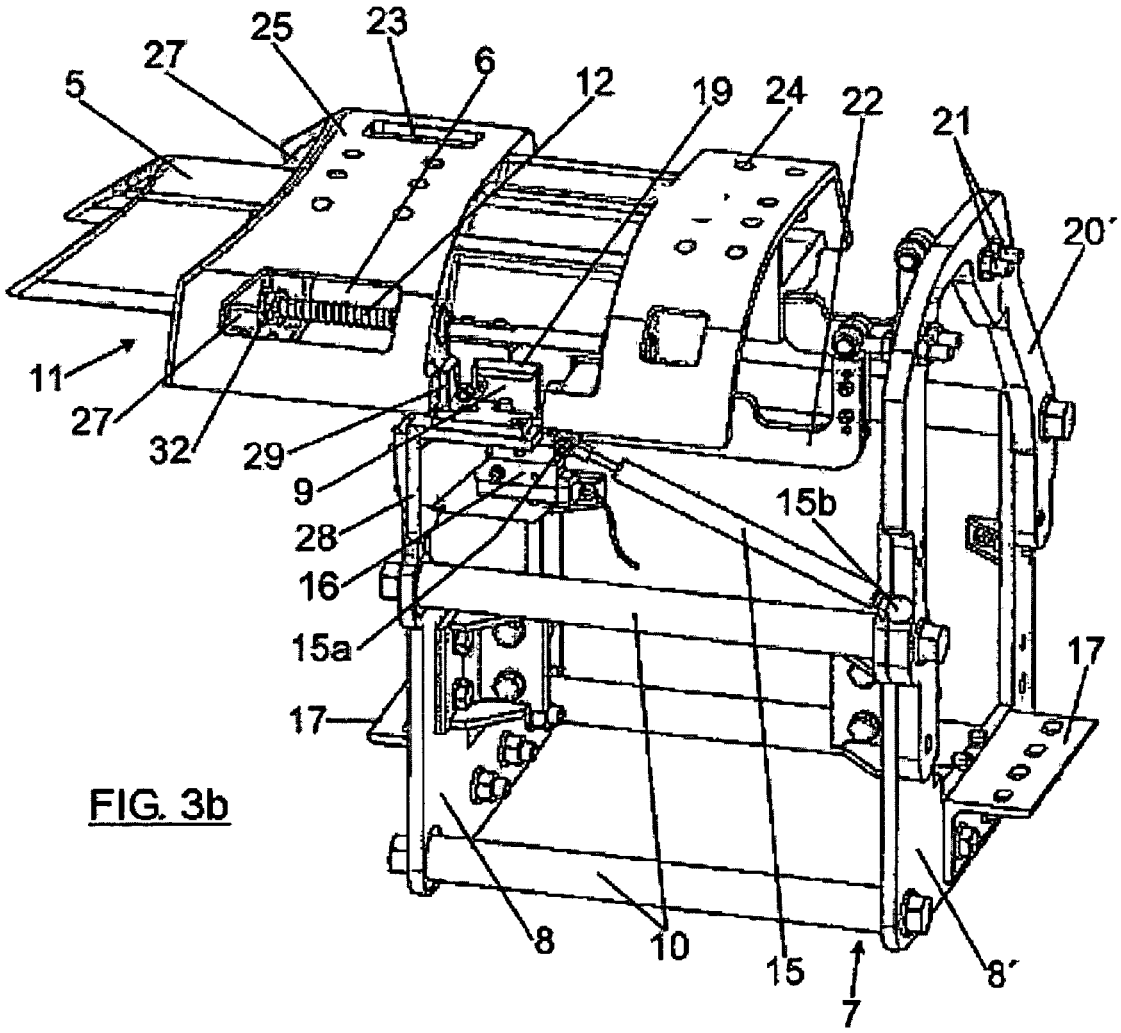
FIG. 3*b* shows a perspective view of the isolated safety device (without showing the rest of the structure of the handrail) similar to FIG. 3*a*, but with another point of view in order to better observe some of the components of the device.
Figure 4:
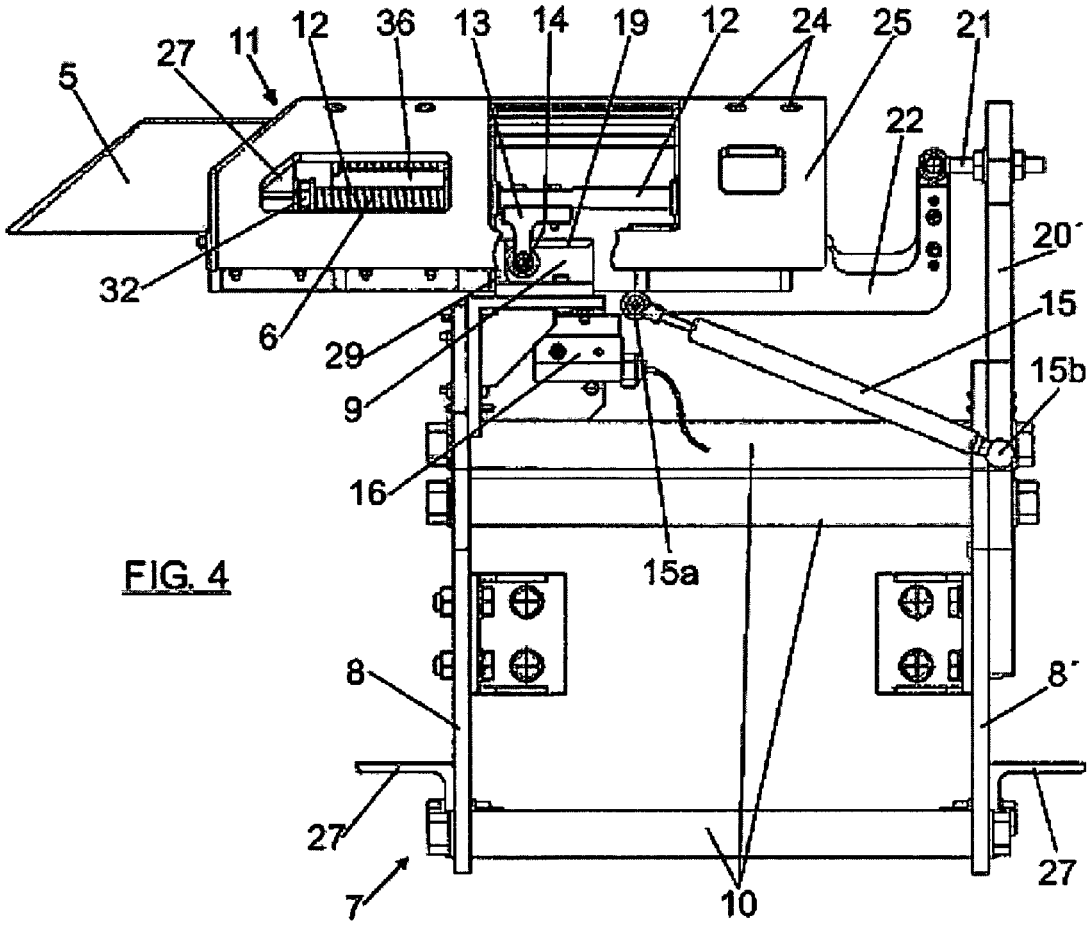
FIG. 4 shows a side view of the safety device shown in FIG. 3.
Figure 5:
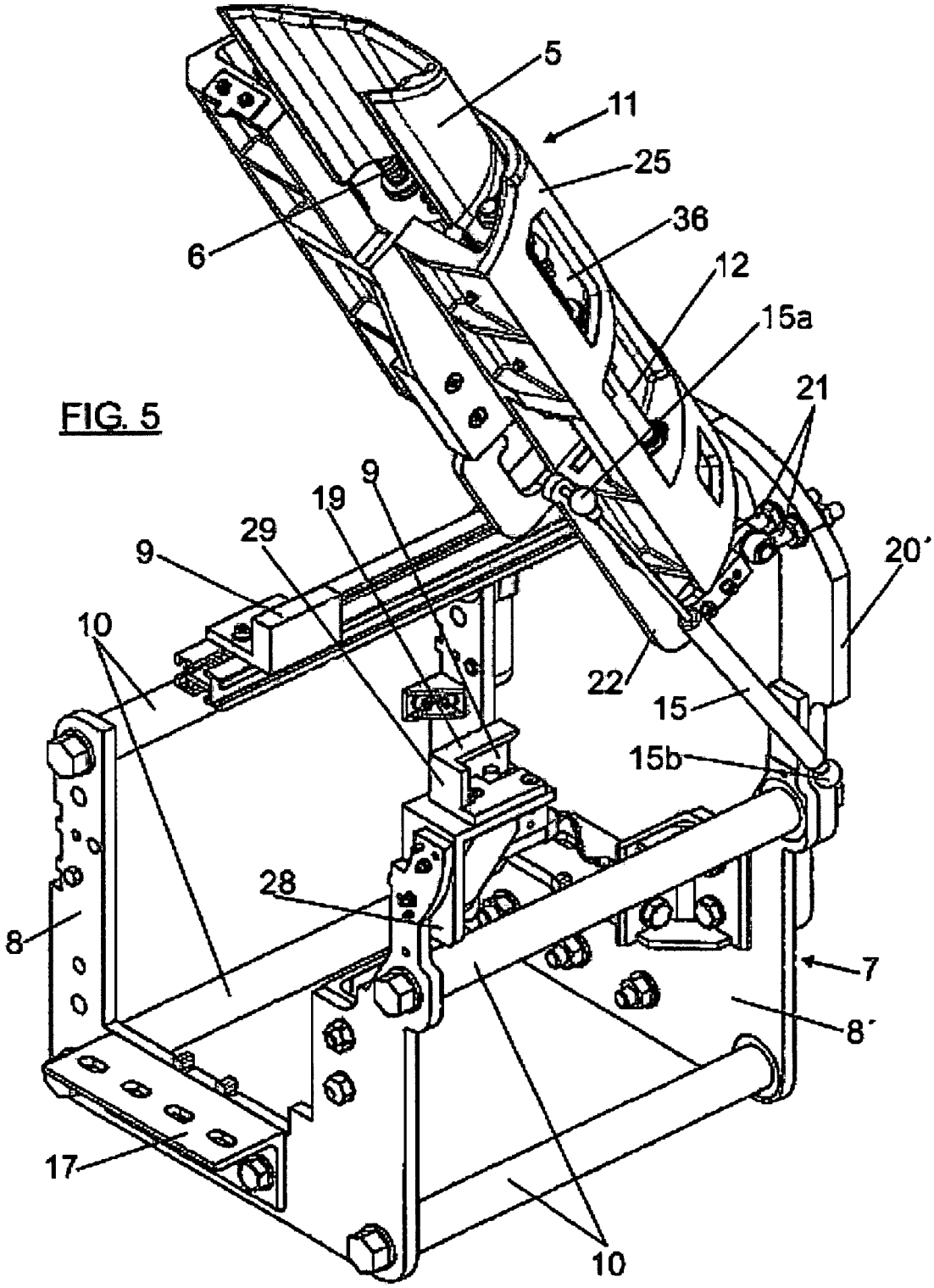
FIG. 5 shows a perspective view of the safety device shown in FIG. 3, but in an unfolded position once the hand of the user has activated said safety device.

The railing (3) has an opening (4) close to which there is arranged a stop (5) which can be introduced through the mentioned opening inside the railing, such stop therefore being retractable against the tension exerted by a pair of springs (6). Said stop is formed in a single body and the mentioned stop (5) is connected to a pair of guiding rods (12) which are located inside the mentioned springs (6) and form part of a lowerable body (11) which can rotate with respect to a support structure (7) according to a rotating shaft perpendicular to the forward direction of the moving handgrips (1). Said support structure (7) can be fixed to the railing (3) by means of joining plates (17), for example (see FIGS. 3 and 5).

The support structure (7) comprises a front plate (8) and a rear plate (8'), the structure being stiffened by a plurality of bars (10) perpendicular to both plates and interconnecting such plates, in the present case a total of four bars (10) with a circular section located in the four vertices of the plates (8-8') will be used.

A retaining guide (9) will be located joined to the front plate (8) through an angle bracket (28), such that said guide will be located perpendicular to the mentioned front plate (8), defining a rolling path parallel to the direction of movement of the moving handgrips (1).

The guide (9) is arranged in one of the branches, specifically the horizontal branch, of the angle bracket (28), which guide in this embodiment consists of a square-shaped flat bar such that its horizontal wall is attached to the horizontal wall of the angle bracket (28), a front lid (29) and an upper flange (19) being arranged.

The rear plate (8') will in turn have an upper portion (20'), which in the present embodiment is independent of said rear plate but which could be a single part, said portion having an inverted "U" arch shape, a pair of anchoring points which are aligned according to the horizontal being arranged in the horizontal branch of said portion, respective pivoting elements (21) being located in the mentioned anchoring points for the connection of respective arms (22) emerging from the rear part of the lowerable body (11). The mentioned pivoting elements (21) will define the lowering and/or pivoting shaft of the lowerable body (11) with respect to the support structure (7). In this specific embodiment, the arms (22) will be "L"-shaped, having in turn two parts which can be connected to one another to define the mentioned arm.

The lowerable body (11) has an upper casing (25) having a plurality of openings and holes (23-24) and the stop (5) passing through said body (11); said casing having an intermediate transverse partition (26) through which there passes the guiding rod (12) associated to the stop (5) which is located parallel to the forward direction of the moving handgrips (1) of the handrail. The upper casing has respective front side openings (36) allowing the guiding rods (12) with their corresponding springs (6) to be accessible.

The stop (5) has tabs (27) located at its sides on which the respective guiding rods (12) are fixed, the springs (6) being located between retaining washers (32) and surrounding the guiding rods (12). The mentioned tabs (27) will slide over respective tracks (35) made in the front part of the body (11).

A runner (13) is located in the guiding rod portion comprised between the partition (26) and the rear part of the body (11), which runner has at its lower part a roller (14) which have the possibility of moving in a direction parallel to the forward direction of the moving handgrips (1) on the guide (9) of the support structure (7).

The lowerable body (11) and the support structure (7) are connected to one another, on one hand by means of the pivoting elements (21) associated to the rear plate (8') of said structure and the arms (22) associated to the rear part of the lowerable body (11) and on the other hand, by means of a driving element (15) which is joined, with the possibility of rotation according to a rotating shaft parallel to the lowering shaft of the lowerable body (11), at one of its ends (15*a*) to the lower base of said lowerable body and at the other end (15*b*), with the possibility of rotation according to a rotating shaft parallel to the mentioned one, it will be joined to the rear plate (8') close to an end of one of the bars (10). In this preferred embodiment of the invention, the driving element consists of a gas cylinder of the type of those having a delayed extension, said cylinder being assembled in a compressed position when the body (11) is in a rest or folded position.

To complete the system, an electronic contact microswitch (16) is arranged on the guide (9) associated to the body (11) and more specifically at the end part of the run or path thereof, the main mission of such microswitch is to act as a switch or cutter of the power supply, to thus stop the movement of the entire system (handrail+walkway) when the hand of the user impacts on the retractable stop (5).

Figure 1:
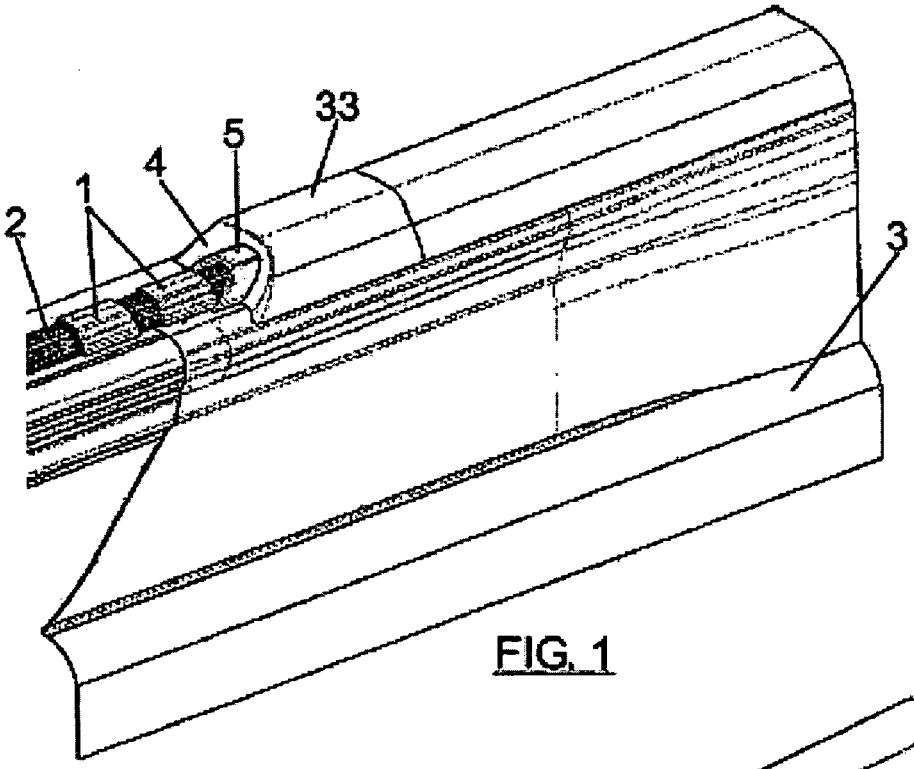
FIG. 1 shows a perspective view of a moving handrail forming part of a walkway or mechanical stairs in a normal operational position, said handrail incorporating the safety device object of the present invention.
Figure 2:
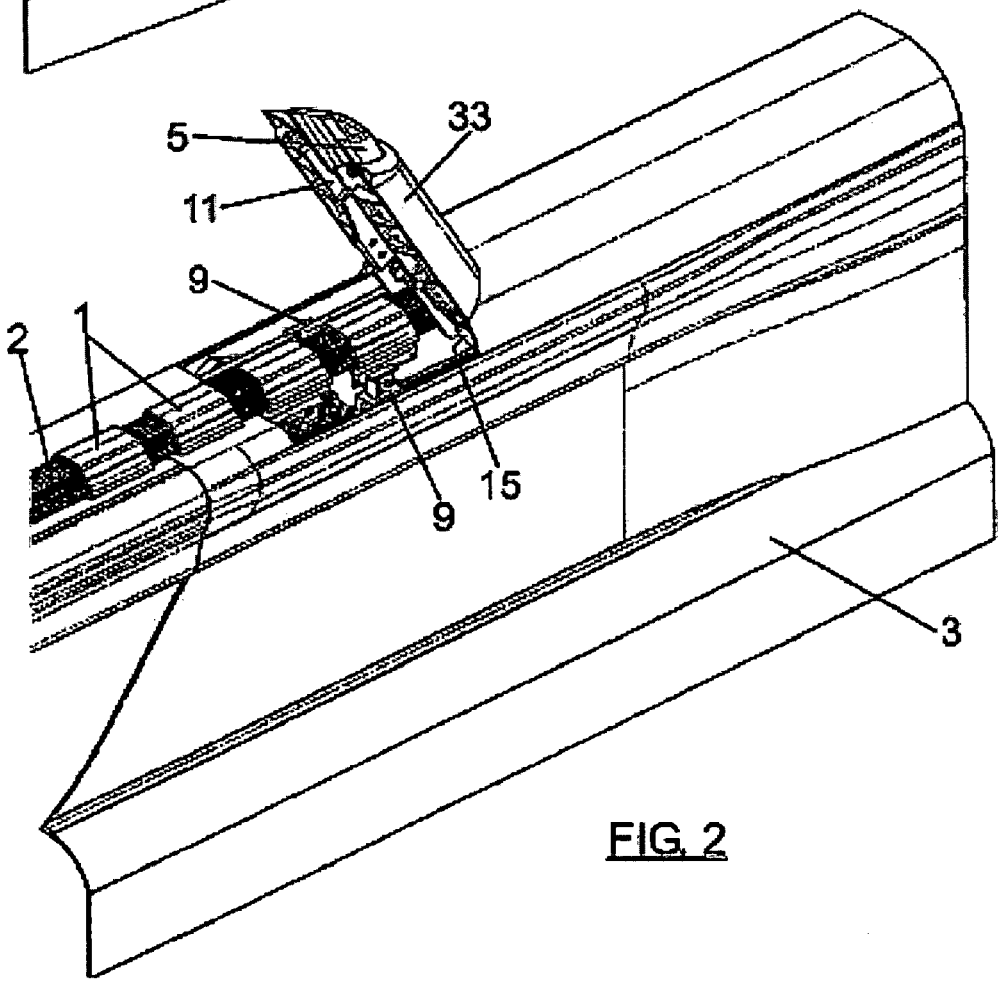
FIG. 2 shows a perspective view similar to that shown in FIG. 1 at the time in which the safety device object of the present invention has acted, the upper part of the handrail being lowered.

In FIGS. 1 and 2, the body (11) is concealed by an outer casing (33) which is arranged to maintain the continuity of the upper ornamenter of the railing and so that the existence of the safety system is not observed at first sight.

The device operates as follows: firstly, when the user does not notice that he or she is reaching the end of the walkway, keeping his or her hand on the moving handgrips (1) of the handrail, the hand impacts against the stop (5) which, since it is retractable, is introduced through the opening (4) of the railing (3), driving in its linear movement the guiding rod (12) belonging to the lowerable body (11) making the runner (13) run over the length of the guide (9) of the support structure (7), until reaching a point in which the upper flange (19) of said guide allows releasing the roller (14) from the runner (13), at which time due to the action of the driving element (15), which is located forming a triangle with the rear plate (8') and the lower base of the body (11), it is raised with respect to the guide (9), coming out if it and continuing with the lowering movement of the body (11) up to a height such that it allows the passage of the hand, and said body (11) and stop (5) do not form a risk for said hand. At the same time that the roller (14) is released, it passes through the electronic microswitch (16) installed on the guide which is responsible for interrupting the force supply of the walkway and of the handrail, the system being automatically stopped.

Once the system has been stopped, the safety device is at rest by simply pushing in a downward vertical direction on the highest free end of the body (11), which when it is located in a horizontal position and as a result of the action of the springs (6), makes the runner (13) move backwards on the guide (9) to its initial rest position, and the roller (14) of the runner colliding against the front lid (29) of the guide (9).

The device further has sensors (now shown in the figures) which in the present embodiment are located in front of the moving stop (5) for the purpose of detecting the presence of a user located close to the entrance of the handrail and in the event of a positive detection, warning by means of an acoustical signal.

The invention claimed is:

1. A safety device for moving handrails such as those used in transport systems comprising mechanical stairs and walkways, wherein said handrail, at one exit end of the handrail, comprises a plurality of moving handgrips which can move on a modular guide covered by them, said moving handgrips penetrating at their exit end inside a fixed and hollow railing, the railing of which has an opening, the device comprising:

a stop:

located in correspondence with the opening;

retractable against the tension of at least one spring;

wherein the device comprises:

a lower support structure forming part of the railing itself, comprising:

a front plate at the upper end of which there is arranged at least one retaining guide and a rear plate, said plates being connected by a plurality of bars perpendicular thereto a lowerable body with respect to said support structure according to a rotating shaft perpendicular to the forward direction of the moving handgrips, said rotating shaft being located in the rear plate of the support structure, the lowerable body of which comprises:

a guiding rod integral with stop to which a runner is joined in an integral manner, which runner has a roller which can move in a direction parallel to the forward direction of the moving handgrips on the guide when the stop is acted upon a driving element of the lowerable body, one of the ends of which is connected with the possibility of rotation to the support structure and the other end of which is connected with the possibility of rotation to the lowerable body such that when the retractable stop is pushed by the hand of the user, the movement is transmitted by the guiding rod moving the runner which is released from the guide, the lowerable body being lowered due to the effect of the driving element.

2. A device according to claim 1, wherein the driving element comprises a gas cylinder which is compressed in the rest position of the device.

3. A device according to claim 1, wherein an electronic microswitch is arranged on the retaining guide of the support structure, which microswitch, in the folded position of the lowerable body, keeps the power circuit of the mechanical walkway associated to the handrail on, the movement thereof occurring, and, in the lowered position of said lowerable body is actuated by the roller of the runner, interrupting the power circuit of the walkway and stopping it.

4. A device according to claim 1, wherein it comprises a pair of sensors located in front of a moving stop in order to detect the presence of a hand of a user located close to the entrance of the handrail and in the event of a positive detection, to warn the user by means of an acoustical signal.

* * * * *